US009808660B2

(12) United States Patent
Kilburn

(10) Patent No.: US 9,808,660 B2
(45) Date of Patent: Nov. 7, 2017

(54) FIRE FIGHTING APPARATUS AND METHOD

(71) Applicant: Robert Shane Kilburn, Huntington Beach, CA (US)

(72) Inventor: Robert Shane Kilburn, Huntington Beach, CA (US)

( * ) Notice: Subject to any disclaimer, the term of this patent is extended or adjusted under 35 U.S.C. 154(b) by 134 days.

(21) Appl. No.: 14/675,725

(22) Filed: Mar. 31, 2015

(65) Prior Publication Data

US 2016/0287919 A1 Oct. 6, 2016

(51) Int. Cl.
*A62C 8/00* (2006.01)
*A62C 3/02* (2006.01)
*A62C 99/00* (2010.01)

(52) U.S. Cl.
CPC ..... *A62C 3/025* (2013.01); *A62C 99/0045* (2013.01)

(58) Field of Classification Search
CPC ..... A62C 99/0045; A62C 3/25
USPC ..... 169/36
See application file for complete search history.

(56) References Cited

U.S. PATENT DOCUMENTS 1,903,348 A * 4/1933 Anderson ..... F42B 25/00 102/369
2,328,491 A * 8/1943 Erwin ..... F42B 27/08 169/28
2,703,527 A 3/1955 Hansen
3,980,139 A 9/1976 Kirk
4,285,403 A 8/1981 Poland
4,344,489 A 8/1982 Bonaparte
4,964,469 A 10/1990 Smith
5,590,717 A 1/1997 McBay et al.
5,894,891 A 4/1999 Rosenstock et al.
(Continued)

FOREIGN PATENT DOCUMENTS

CN 1458495 A 11/2003
CN 1597020 A 3/2005
(Continued)

OTHER PUBLICATIONS

Anval Valves Pvt Ltd; Bulk Density Chart.
(Continued)

*Primary Examiner* — Jason Boeckmann
(74) *Attorney, Agent, or Firm* — WHGC, P.L.C.; John F. O'Rourke

(57) ABSTRACT

Apparatus and method for firefighting includes a containerless core of a fire retardant material, compressed to form a prolate spheroid shape. A shaft with fins and a carrying hook can extend from the core tail. The core can have a core charge of an explosive material within the core channel. An altimeter sensor coupled to the core charge and a triggering mechanism is coupled between the altimeter sensor and the core charge, and causes the triggering mechanism to detonate the core charge when the apparatus reaches an altitude. A delivery apparatus is included with a frame having carry harness, and at least one holding hook on the frame coupled to the carrying hook. The carry harness supports delivery apparatus in transport. Powders of calcium carbonate, magnesium carbonate, ammonium sulfate, diammonium sulfate, diammonium phosphate, ammonium polyphosphate, or monoammonium phosphate can be intermixed as fire retardant, along with indigenous plant seed.

8 Claims, 5 Drawing Sheets

(56) References Cited

U.S. PATENT DOCUMENTS

| | | | | |
|---|---|---|---|---|
| 5,894,892 | A | 4/1999 | Huang | |
| 6,012,531 | A | 1/2000 | Ryan | |
| 6,318,473 | B1 | 11/2001 | Bartley et al. | |
| 6,470,805 | B1 * | 10/2002 | Woodall | A62C 3/025 102/370 |
| 6,796,382 | B2 | 9/2004 | Kaimart | |
| 7,089,862 | B1 | 8/2006 | Vasquez | |
| 7,261,165 | B1 | 8/2007 | Black | |
| 7,690,438 | B2 | 4/2010 | Bordallo | |
| 7,975,774 | B2 | 7/2011 | Akcasu | |
| 7,992,647 | B2 | 8/2011 | Cordani | |
| 8,746,355 | B2 * | 6/2014 | Demmitt | A62C 3/025 102/369 |
| 8,800,674 | B2 | 8/2014 | Hartmann et al. | |
| 2004/0134672 | A1 | 7/2004 | Tsao | |
| 2013/0048317 | A1 | 2/2013 | Charlton | |

FOREIGN PATENT DOCUMENTS

| | | | |
|---|---|---|---|
| CN | 101073696 | A | 11/2007 |
| CN | 101485924 | A | 7/2009 |
| CN | 102784448 | A | 11/2012 |
| EP | 945153 | A1 | 9/1999 |
| EP | 2163844 | A3 | 3/2012 |
| KR | 1020010008388 | A | 2/2001 |
| ZA | 1995/06583 | | 8/1995 |

OTHER PUBLICATIONS

L.V. Krishnamoorthy, D.R. Kirk and R. Glass; An Aerodynamic Database for the Mk 82 General Purpose Low Drag Bomb; DSTO Aeronautical & Maritime Research Lab; Jul. 1997.

International Plant Nutrition Institue; Monoammonium Phosphate; Nutrient Source Specifics; No. 9; Ref# 10069.

Solvay America, Inc.; Product Safety Summary—Sodium Bicarbonate (Baking Soda); Cas No. 144-55-8.

Tapco Inc.; Bulk Material Density Table.

Weatherford; Calcium Carbonate Ground Calcite; Feb. 2010.

Interagency Helicopter Operations Guide; Chapter 6: Helicopter Capabilities and Limitations; Feb. 2013.

aerospace-technology.com; Bell/Agusta Bell 412.

http://elidefireball.elidefire.info/index-1.html.

Simplex Aerospace Aviation Mission Equipment; http://www.simplex.aero/fire-attack/bell-ab412-ab412ep-205a-1-205b-212-412-ep-uh-1h/.

Kathleen A. Dadey, Tom Janecek, and Adam Klaus; 37. Dry-Bulk Density: Its Use and Determination; Proceedings of the Ocean Driling Program, Scientific Results, vol. 126.

* cited by examiner

FIRE FIGHTING APPARATUS AND METHOD

BACKGROUND

1. Field of the Invention

The present invention relates to firefighting equipment and, more particularly, to an aerial-delivered fire retardant device.

2. Background of the Invention

In the western United States, wildfires cause widespread destruction of nature, buildings, and lives. Billions of dollars are spent annually on wildfire suppression. Because even a small wildfire can overwhelm typical structural firefighting equipment, air-based resources are often brought to bear, including fixed- and rotary-winged aircraft. Fixed-wing aircraft must make a pass over the wildfire and drop water or retardant like a bomber. Helicopters can hover over the fire and drop water or retardant. However, each aircraft is "committed" to release their entire fire suppressant load at one time, and must leave the scene for reloading. In addition, aircraft must fly dangerously close to the fire to drop their payload, for example, about 500 feet above ground level.

Common materials used to fight wildfires include water and fire retardants. Water is usually dropped directly on flames because its effect is short-lived. Fire retardants are typically dropped ahead of the moving fire or along its edge and may remain effective for two or more days. Currently, fire retardants are typically applied in liquid or semi-liquid form. Present retardants include ammonium sulfate, diammonium sulfate, diammonium phosphate, ammonium polyphosphate, or monoammonium phosphate. These retardants are less toxic than sodium or boron salts, which can sterilize the ground or make regrowth difficult. These retardants also act as fertilizers to help the regrowth of plants after the fire. However, such fire retardants can be complex mixtures of chemicals to facilitate its efficacy. For example, fire retardants often contain wetting agents, preservatives, thickeners, rust inhibitors, and coloring agents. Examples of coloring agents are ferric oxide (red) or fugitive color to mark where they have been dropped. Thickeners include attapulgite clay, or a guar gum derivative, and are used to prevent dispersal of the retardant after it is dropped from the plane. Brand names of aqueous fire retardants for aerial application include Fire-Trol® and Phos-Chek®. Fire-Trol® aerial fire retardants are available from Fire-Trol Holdings, LLC, Phoenix, Ariz. Phos-Chek® aerial fire retardants are available from ICL Performance Products in Ontario, Calif. Class A foams also may be used as fire retardants. Class A foams lower the surface tension of the water, which assists in the wetting and saturation of Class A fuels with water. This can aid fire suppression and can prevent re-ignition. However, foams tend to be short-lived suppressants.

Nevertheless, aqueous fire-fighting materials can be problematic. Water, while inexpensive, can be difficult to reach and to deliver in remote areas or in treacherous terrain. Also, without a thickener or wetting agent, water tends to runoff very quickly and be absorbed into a small area of soil. Water is heavy, weighing approximately 8 pounds per gallon. Thousands of gallons of water, or more, are used even in a small wildfire. As aqueous mixtures, fire retardants can be heavy, like water, but they also are expensive and more finite in quantity. What is needed is a biologically-friendly, plentiful, lightweight, fire retardant, which can be easily delivered from a safe distance, even in remote or dangerous conditions.

SUMMARY

Embodiments herein provide an apparatus and method for firefighting. Firefighting apparatus embodiments can include a containerless core of a preselected fire retardant material, having a core tail, a core nose, and a core channel extending therebetween. The core can be a preselected fire retardant material that is compressed to form a prolate spheroid shape. A shaft can be coupled to and extend from the core tail, with the shaft having a proximal end near the core tail and a distal end opposite the proximal end, and a plurality of fins coupled to the distal end of the shaft. The containerless core can have a core charge of a preselected explosive material disposed within the core channel. There can be an altimeter sensor coupled to the core charge and a triggering mechanism coupled between the altimeter sensor and the core charge. The altimeter sensor causes the triggering mechanism to detonate the core charge when the apparatus reaches a predetermined altitude, above ground level.

Some embodiments of the firefighting apparatus can include an arming mechanism coupled to the triggering mechanism, the arming mechanism causing the triggering mechanism to arm the core charge for explosion in an armed state and preventing the core charge from exploding in a stand-down state. The arming mechanism has an arming tab extending from the shaft distal end. Also, a nose cone coupled to the core nose can have the altimeter sensor and the triggering mechanism disposed within. The triggering mechanism can be coupled between the altimeter sensor and the core charge. A cable can be coupled between an altitude sensor and the core charge via the triggering mechanism, wherein the triggering mechanism transmits a detonation signal to the core charge in response to an altitude signal from the altitude sensor. Further embodiments can include a spiked spine traversing the core from the nose cone to the shaft distal end with a plurality spikes extending from the spiked spine into the compressed preselected fire retardant material, preventing shifting thereof. Also, a carry hook can be coupled to the shaft distal end, with the carry hook being disposed to suspend the firefighting apparatus when in aerial transit. Certain selected embodiments can include a carrying hook extending from the shaft of the firefighting apparatus.

A delivery apparatus including a rigid frame having a frame top and a frame bottom, a carry harness secured to the frame, at least one holding hook coupled to the frame bottom, and a nose cup on the frame top, above the holding hook. The carrying hook of the frame is releasably coupled to the holding hook on the firefighting apparatus. The carry harness supports the transport of the delivery apparatus, for example, from a remote staging area to a locus of a fire. A wiring harness can be coupled between the control panel and the arming mechanism, causing the arming of triggering mechanism upon break-away from the delivery apparatus. In some embodiments, the core charge includes one of a C4-based explosive or an ammonium nitrate-based explosive, and an electric blasting cap to detonate the core charge.

The preselected fire retardant material can be calcium carbonate powder, magnesium carbonate powder, or both. At least one of powders of magnesium carbonate, ammonium sulfate, diammonium sulfate, diammonium phosphate, ammonium polyphosphate, or monoammonium phosphate can be intermixed with the preselected fire retardant material. In yet other embodiments, the fire retardant materials can include two or more of the powders of calcium carbonate, magnesium carbonate, ammonium sulfate, diammonium sulfate, diammonium phosphate, ammonium polyphosphate, monoammonium phosphate, or attapulgite clay.

Certain embodiments have an indigenous plant seed mixed in with the preselected fire retardant material. The preselected fire retardant material can act as a fertilizer. Some embodiments can employ indigenous grass seed as the indigenous plant seed.

Firefighting method embodiments, for firefighting apparatus delivery by a carrier system, can include providing a delivery apparatus having a firefighting apparatus positionally loaded thereon, providing a carrier harness between the carrier system and the delivery apparatus, releasably securing the delivery apparatus to the carrier system with the carrier harness, providing a wiring harness between a holding hook on the delivery apparatus and a control panel, wherein the holding hook is electrically operable from the control panel, releasably coupling the holding hook to a carrying hook attached to a firefighting apparatus, and coupling an arming mechanism of the firefighting apparatus to a holding hook. The method can include bringing the carrier system into the proximity of a fire, electrically releasing the holding hook, wherein the firefighting apparatus is released from the delivery system and directed towards the fire. The firefighting apparatus is armed to detonate at a predetermined height above ground level.

The method also includes multiple firefighting apparatus by providing a delivery apparatus having a plurality of firefighting apparatus positionally loaded thereon, providing a wiring harness between a plurality of holding hooks on the delivery apparatus and the control panel, wherein each of the plurality of holding hooks is electrically operable from the control panel, releasably coupling a holding hook to respective carrying hooks individually attached to the plurality of firefighting apparatus, and coupling arming mechanisms of the plurality of firefighting apparatus to respective holding hooks. Some embodiments further include bringing the delivery apparatus into a locus of a fire, electrically releasing selected ones of the holding hooks, wherein corresponding firefighting apparatus are released from the delivery system towards the fire, and arming ones of the firefighting apparatus to detonate at a predetermined height above ground level, upon electrically releasing. Further method embodiments include providing a stacked plurality of delivery apparatus, each with a corresponding plurality of firefighting apparatus. In selected embodiments, providing a delivery apparatus having a firefighting apparatus positionally loaded thereon includes one of horizontally positionally loaded, vertically positionally loaded, or angularly positionally loaded.

BRIEF DESCRIPTION OF THE DRAWINGS

The figures herein provide illustrations of various features and embodiments in which.

Figure 1:
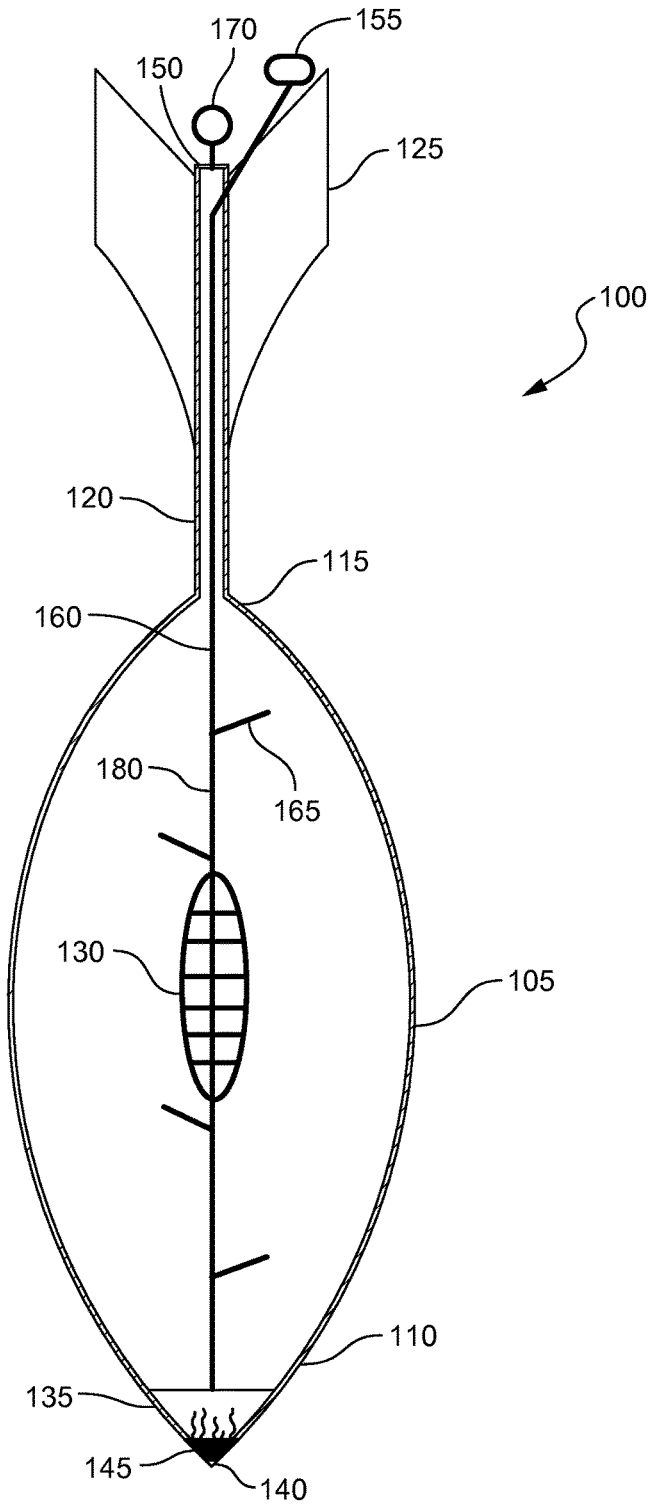
FIG. 1 is a cut-away view of a firefighting apparatus, according to the teachings of the present invention.

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated.

DETAILED DESCRIPTION

The embodiments herein provide a firefighting apparatus that is effective, inexpensive, easy to use, safe to handle, and biodegradable. Also, some embodiments include seeds, which may be grass seeds, and which may be indigenous to the locale in which the wildfire is occurring.

Turning to FIG. 1, a cross-section, firefighting apparatus 100 includes a core 105 with core nose 110 and core tail 115, shaft 120 coupled to and extending from core tail 115, plurality of aerodynamic fins 125 coupled to the distal end 150 of shaft 120, core charge 130 embedded within core 105, and nose cone 135, which can be fitted onto core nose 110. Nose cone 135 can house altimeter sensor 140, and triggering mechanism 145, and can connect to core charge using internal wiring harness 147. Wiring harness 147 also is operably coupled to arming mechanism 155. Handling of apparatus 100 can be rendered relatively safe by providing breakaway arming mechanism 155. With arming mechanism 155 in place, firefighting apparatus 100 can be in a quiescent "STAND-DOWN" state. Also, apparatus 100 may include spine 160 having a plurality of barbs 165 extending outward in to core 105. Barbs 165 may be long enough to prevent shifting and dislodgment of at least a portion of the core from the rest of apparatus 100. Spine 160 may be coaxially disposed within core channel 180.

Core channel 180 may be formed during the forming of core 105. Core channel 180 can contain arming and triggering wires (not shown), as well as core charge 130. Carrying hook 170 may be used to suspend apparatus from a releasable hook or latch (not shown) during transport of apparatus to the wildfire site. Once firefighting apparatus 100 is released and begins its descent, arming mechanism 155 is actuated, for example, by pulling off an arming tab, to place triggering mechanism 145 into the "ARMED" state. In the "ARMED" state, triggering mechanism 145 can be activated to detonate at a predetermined height AGL, for example at 200 feet AGL, as determined by altimeter sensor 140.

Core 105 can include between about 220 pounds to about 300 pounds of compressed fire retardant material, so that a complete apparatus 100 may weigh between about 250 to about 330 pounds. The remainder of the weight of core 105 may include indigenous grass seed mixed throughout core 105, as well as triggering mechanism 145, altimeter sensor 140, spine 160 and barbs 165, shaft 120, fins 125, and other components. Of course, other core weights are contemplated, with the amount of the compressed fire retardant material in core 105 varying accordingly.

In making a core 105, spine 160 can be assembled using cable 147 with the carrying hook 170 at the top. An explosive can be put into place in the basket for core charge 130 that can be molded in spine 160. Spine 160 then can be placed into a mold and positioned in center of the mold. The chalk-and-seed formula will be made into a liquid and poured into the mold. The mold will be in place for a short time until and mix is stable enough to be removed. At this point core 105 can be somewhat wet and can be let stand to dry. After the drying process is complete core nose 110 can be screwed on and mounted with the carrier device and readied for service. Core 105 can be containerless: no external "skin," shell, housing or carrying case may be needed to contain core 105.

Core 105 can include a primary fire retardant material such as powdered calcium carbonate or powdered magnesium carbonate, or a mixture thereof. Alternatively, one or more mixtures of ammonium sulfate, diammonium sulfate, diammonium phosphate, ammonium polyphosphate, monoammonium phosphate, or attapulgite clay can supplement the primary fire retardant. In general, calcium carbonate is a mineral compound found in most rocks and can be found in all parts of the world. Calcium carbonate and magnesium carbonate are good materials for firefighting materials because they are relatively lightweight and highly compressible. For example, calcium carbonite, or ground calcite, can be powderized and can have an apparent bulk density of about 55-65 lbs $ft^{-3}$ when compacted. The fire retardant material can be highly compressed or compacted to form core 105 such that no outer shell or container is needed to enclose the fire retardant material. In addition, core 105 also can have plant seed, such as grass seed, intermixed with the fire retardant material to facilitate regrowth of the ground layer, which reduces the risk of post-fire mudslides. The grass seed may be selected to be indigenous to the area of the fire, if possible. Any indigenous, fast-growth plant seed also could be used.

Core charge 130 can be manufactured from a high-energy brisant material such as Composition C-4 plastic explosive, ammonium nitrate, or any comparable high detonation pressure, high detonation velocity material, capable of powderizing core 105 upon detonation. For example, ammonium nitrate has a detonation velocity of 5,270 m/s (17,290 ft/s) at a density of 1.30 g/ml. Compound C4 has a detonation velocity of 8,092 m/s (26,550 ft/s) at high density (1.60 g/ml) and a detonation velocity of 7,550 m/s (24,770 ft/s) at low density (1.48 g/ml). Other explosives within this range, suitable for manufacturing the apparatus 100 may be used. Lower-velocity explosives may shatter instead of powderize core 105, causing incomplete pulverization of core 105. An electric blasting cap typically is used to detonate the charge, for example, using electric current heating. An electric blasting cap contains an easy-to-ignite explosive that provides the initial activation energy to start a detonation in a more stable explosive. These are well-known in the art. Total weight of core charge 130 can be between about one-half pound to one pound of explosive, including blasting cap. When powderized, the fire retardant material can form a dust cloud that settles over the fire, extinguishing or slowing the fire. The dust cloud (e.g., calcium carbonate) then can settle over the burning embers, reducing the likelihood of fire reflash, and further robbing the fire of oxygen. In addition to powderizing the core, the explosive charge can disrupt a region of fire proximate to the blast area, and may extinguish it. The indigenous plant seed, which may be grass seed, can intermingle with the fire debris, and later germinate when the fire is extinguished.

Typically, apparatus 100 is deployed by a fixed- or rotary-winged device and dropped over an active wildfire (e.g., in a forest, in a refinery, in a large building). Unlike most "bombs" which are an ogive, or drawn cylinder, or spherical, in shape, core 105 can be shaped like a prolate spheroid, a "football," to provide improved aerodynamic efficiency during the downward flight of apparatus 100. A prolate spheroid is a spheroid in which the polar axis is greater than the equatorial diameter. Aerodynamic fins 125 can stabilize and orient the fall of the device. Fins 125 may be disposed to cause apparatus 100 to fall in a spiral trajectory to maximize stability while in flight, and accuracy in delivery. Example lengths (spheroid major axis) for core 105 can be between about 26-33 inches long. Example widths (spheroid minor axis) for core 105 can be between 14-18 inches in diameter.

Figure 2:
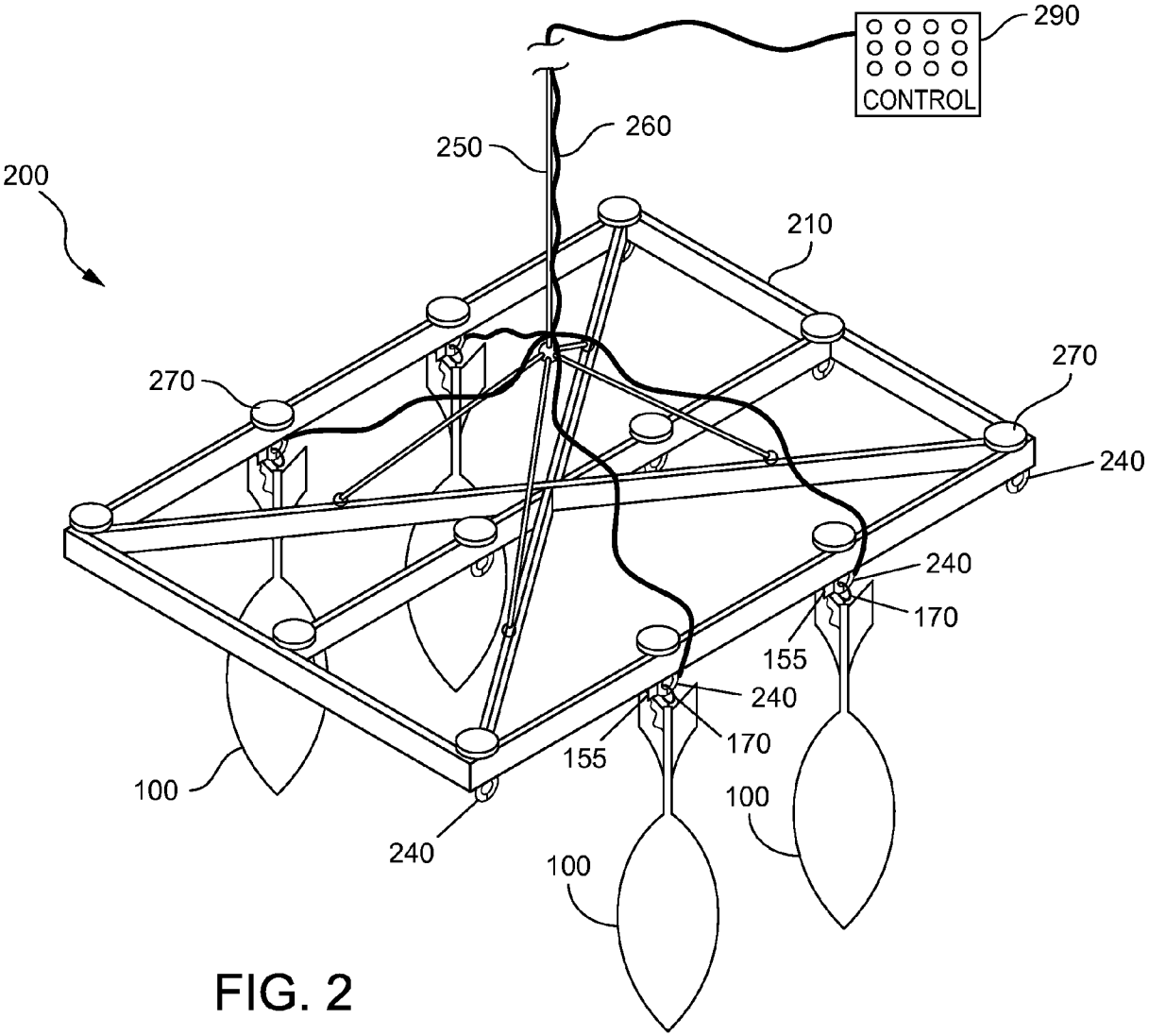
FIG. 2 is a perspective view of a delivery apparatus, according to the teachings of the present invention.

FIG. 2 is an illustration of delivery apparatus 200 for firefighting apparatus 100, in which delivery apparatus can include quadrilateral frame 210 with cross bracing, a plurality of operable holding hooks 240, carrying harness 250 secured between frame 210 and carrier system (not shown), wiring harness 260 coupling release/arming system to firefighting apparatus 100, and nose pads 270 each used while transporting plural delivery apparatus 200 of firefighting apparatus 100. A carrier system may be, without limitation, as rotary-winged aircraft, a fixed-wing aircraft, or a motorized crane boom on a truck, boat, or barge. Holding hooks 240 may be electrically released hooks configured to be electrically opened via wiring harness 260 by a control panel 290 onboard the aircraft, causing the release and arming of firefighting apparatus 100. While firefighting apparatus 100 are disposed on the underside of frame 210, nose pads 270 can be disposed on the top side of frame 210. Nose pads 270 may be used during transport and will be described below. Alternately, nose pads 270 can be attached to frame 210 during the pre-deployment/transport period prior to being attached to an aircraft (not shown). Although delivery apparatus 200 is shown to hold firefighting apparatus 100 in a vertical position, apparatus 200 can be modified to hold firefighting apparatus 100 in a horizontal position or an angular position.

As indicated earlier, with prior art firefighting equipment, fixed-wing aircraft must make a pass over the wildfire and drop water or retardant like a bomber, while helicopters hover over the fire and drop water or retardant. In either case, under the present regime, the aircraft must come perilously close to the fire and blinding smoke in order to deliver a load of fire retardant. Once they drop their firefighting load all-at-once, they are required to clear the scene in order to get another load of fire retardant and to allow other aircraft access to the wildfire site. In the firefighting equipment of the present embodiments, aircraft may maintain a higher and safer altitude relative to the fire due to the aerodynamics of firefighting apparatus 100. Rotary-winged craft can loiter over the fire, selecting drop areas.

Delivery apparatus 200 can be disposed to carry plural firefighting apparatus 100. For example, delivery apparatus 200 can hold 3×4, or 12, firefighting apparatus 100, although a delivery apparatus carrying eight (8) firefighting apparatus 100 also may be used, depending upon the size of the firefighting apparatus 100 and the payload capability of the carrier system (e.g., aircraft, crane boom). Twelve apparatus 100 at 250 pounds each can weigh about 3,000, which can be carried by a medium-payload helicopter such as the Bell 412. Delivery apparatus 200 may be modified to carry eight apparatus 100, but other configurations are contemplated. For example, where larger-payload capacity fixed wing aircraft may be used. Delivery apparatus 200 may be modified to carry one apparatus 100 for delivery by a boom crane. Delivery apparatus 200 can be modified for air, ground, and water/marine carrier systems with payloads and apparatus sizes being modified to fit the platform accordingly.

Delivery apparatus 200 can be made to be strong, reusable, and fire-resistant. Delivery apparatus 200 can have frame 210, sized and shaped to carry a predetermined number of apparatus 100, for example 3×4=12. Frame 210 can be made of a study yet lightweight material that is fire and heat resistant, such as aluminum, heat-resistant plastic, or epoxy resin, which also can be tooled to accept various hardware elements, harnesses, and hooks. Holding hook 240 can be provided for each carrying hook 170 of firefighting apparatus 100, and hook 240 can be made to cooperate with carrying hook 170. Hook 240 can be made to release hook 170, for example, using an electrically-operated clasp. Hook 240 also may be designed to retain arming mechanism tab 155, such that when firefighting apparatus 100 is dropped, triggering mechanism 145 becomes ARMED. Wiring harness 255 can be coupled to all carrying hooks 240, to provide them with a releasing signal from control panel 290 individually or as a group or groups, which releases firefighting apparatus 100 from delivery mechanism 200. Prior to transport to a fire, individual arming mechanisms 155 in a STAND-DOWN state can be coupled to a respective hook 240, and ready the respective firefighting apparatus 100 for deployment onto a fire.

Also, with delivery apparatus 200 holding plural firefighting apparatus 100, an aircraft may deliver some firefighting apparatus 100 to a particular area, and change position in order to re-address the fire at the same or different area, repeating until all firefighting apparatus 100 kept on a delivery apparatus 200 are delivered. As an example, and without limitation, a helicopter may hover over a defined region, individually dropping apparatus 100 strategically into the fire zone. Once delivery apparatus 200 is depleted of firefighting apparatus 100, the aircraft can return to a safe area and be given another loaded delivery apparatus 200 to repeat the process.

Typically, firefighting apparatus 100 is in the "STAND-DOWN" state, even when hooks 240 and 170 are in operable communication. In an embodiment, when firefighting apparatus 100 is dropped from delivery apparatus 200, hook 240 can be operated to separate from hook 170. Set to activate triggering mechanism 145 at a predetermined level AGL prior to deployment, altimeter sensor 140 sends an actuation signal to triggering mechanism 145 and, in turn triggering mechanism activates core charge 130 when the predetermined level is reached, detonating the core charge 130 and dispersing core 105 over a wide area of the fire.

Figure 3:
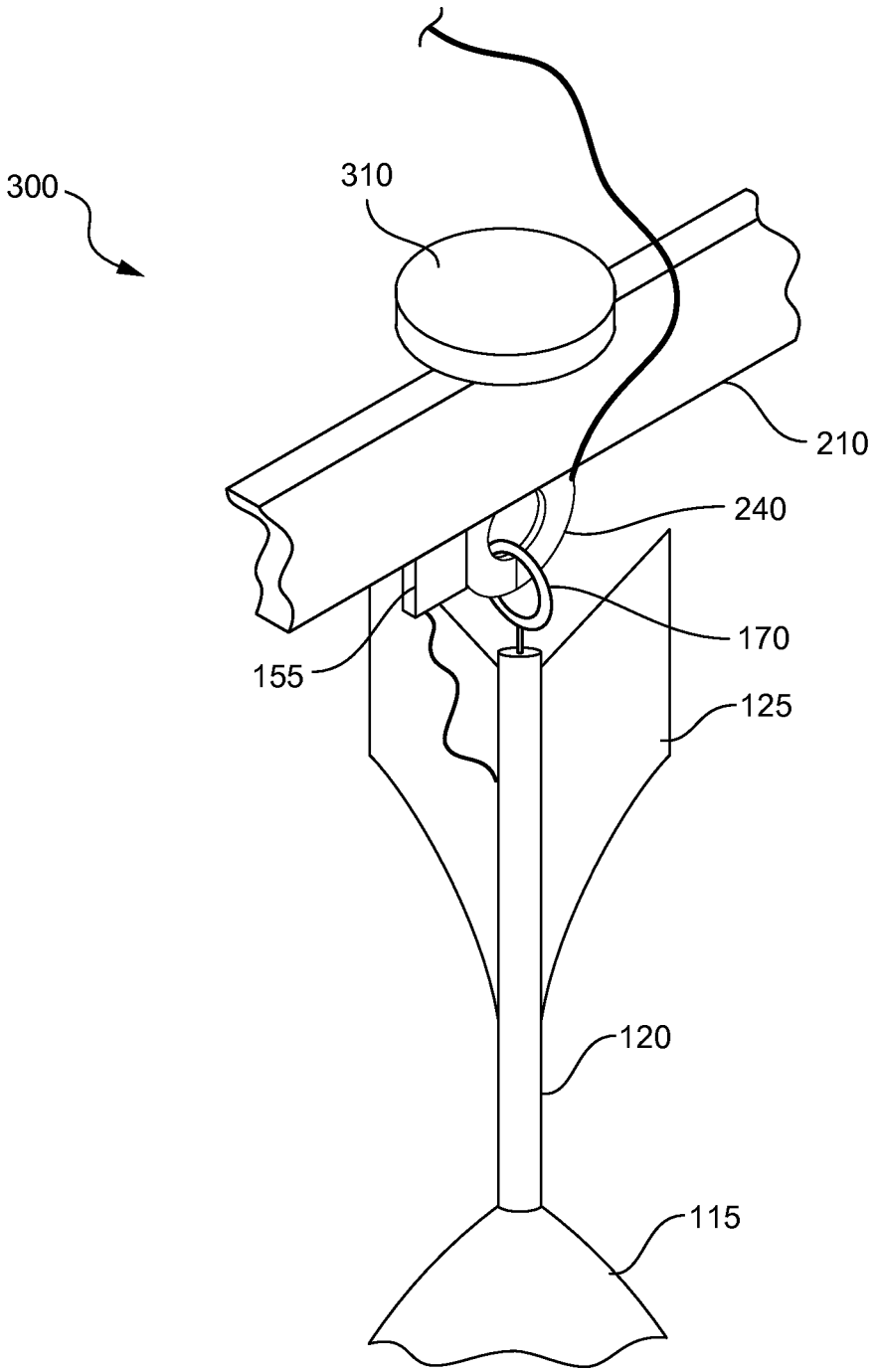
FIG. 3 is a side view of a portion of a delivery apparatus of FIG. 2, according to the teachings of the present invention.

FIG. 3 can be an example of a firefighting apparatus-frame portion 300, which shows a portion of core tail 115, shaft 120, fin portion 125, arming mechanism 155, carrying hook 170, frame 210, holding hook 240, and nose pad 310. Elements are shown in relation to removable attachment to frame 210. Holding hook 240 is shown to be a quick release mechanism for release of firefighting apparatus 100, coupled to carrying hook 170. Holding hook 240 can be disposed on the underside of frame 210. When closed, holding hook 240 can be in the "STANDBY" state. In some embodiments arming mechanism 155 also may be coupled to holding hook 240 so that when holding hook is opened to its "RELEASE" state, arming mechanism 155 is caused to activate firefighting apparatus 100 into the "ARMED" state. Frame 210 can be configured to support another frame above it.

Figure 4:
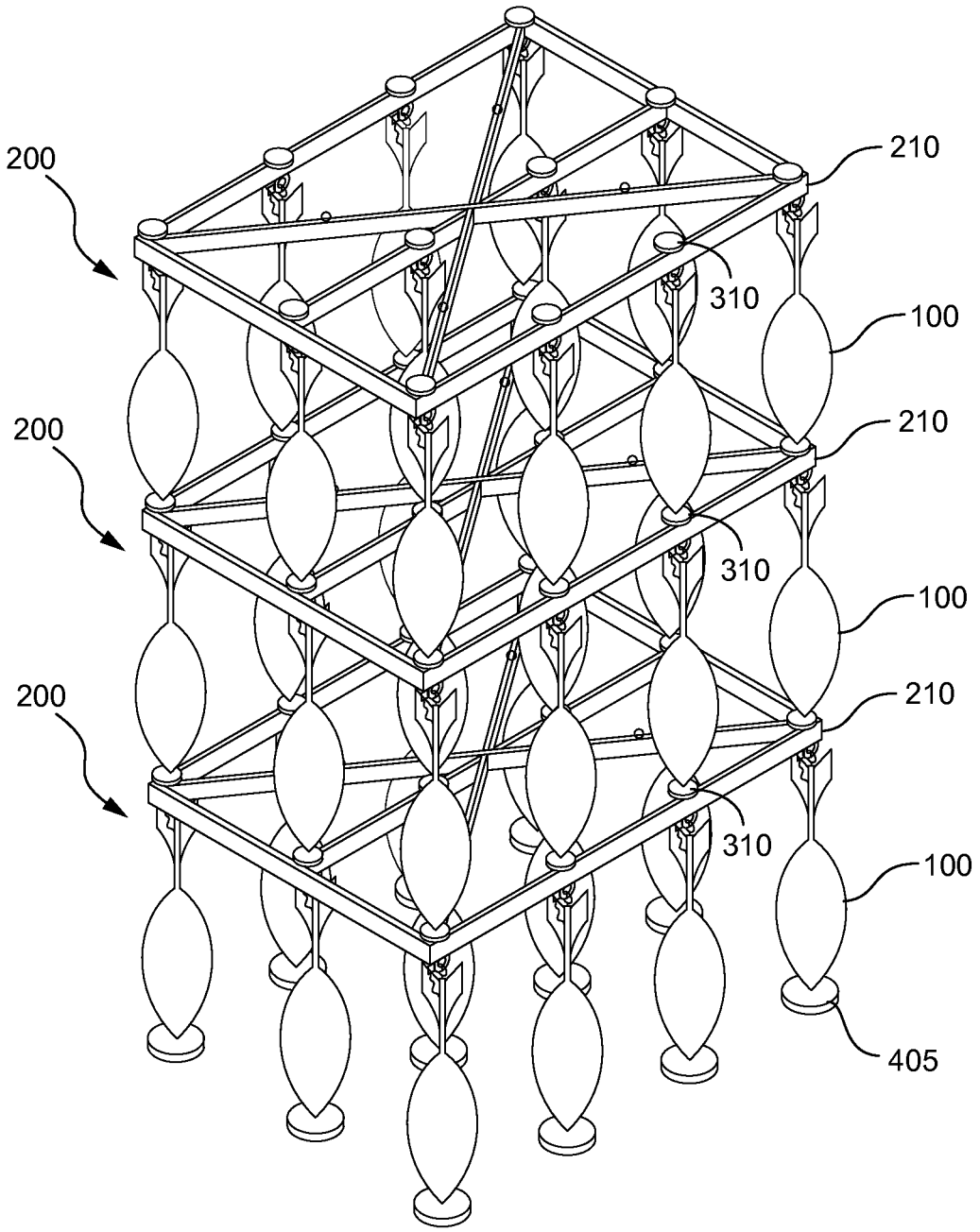
FIG. 4 is a side view of a stack of firefighting apparatus of FIG. 1 and delivery apparatus of FIG. 2, according to the teachings of the present invention.

In some of these embodiments, nose pad 310 can be implemented on the upper side of frame 210, roughly above firefighting apparatus-frame portion 300. Nose pad 310, which may be shaped like a cup, may be positioned above frame 210 and may provide cushioning of nose cone 135 of firefighting apparatus 100. Nose pad 310 can be formed of, for example, an elastomeric material, which may be a thermoplastic elastomer. As is illustrated in FIG. 4, each frame 210 may carry a predetermined number of nose pads 310 arranged in the same configuration as is found on a delivery apparatus 200 above. As illustrated in FIG. 4, loaded delivery apparatus 200 can be modular and may be stacked upon each other after manufacturing, during storage, or during transport, making for easy transport and deployment, once at a staging area for firefighting equipment. Nose cushion 405 can be formed to withstand the shock, vibrations, and movement of transportation and handling, and may be made of, for example, an elastomeric material, which may be a thermoplastic elastomer. Nose cushion 405 may be thicker than nose pad 310, and may be deployed on the bottommost layer to protect the nose cones of the apparatus 100 array on the bottommost delivery apparatus 200.

Figure 5:
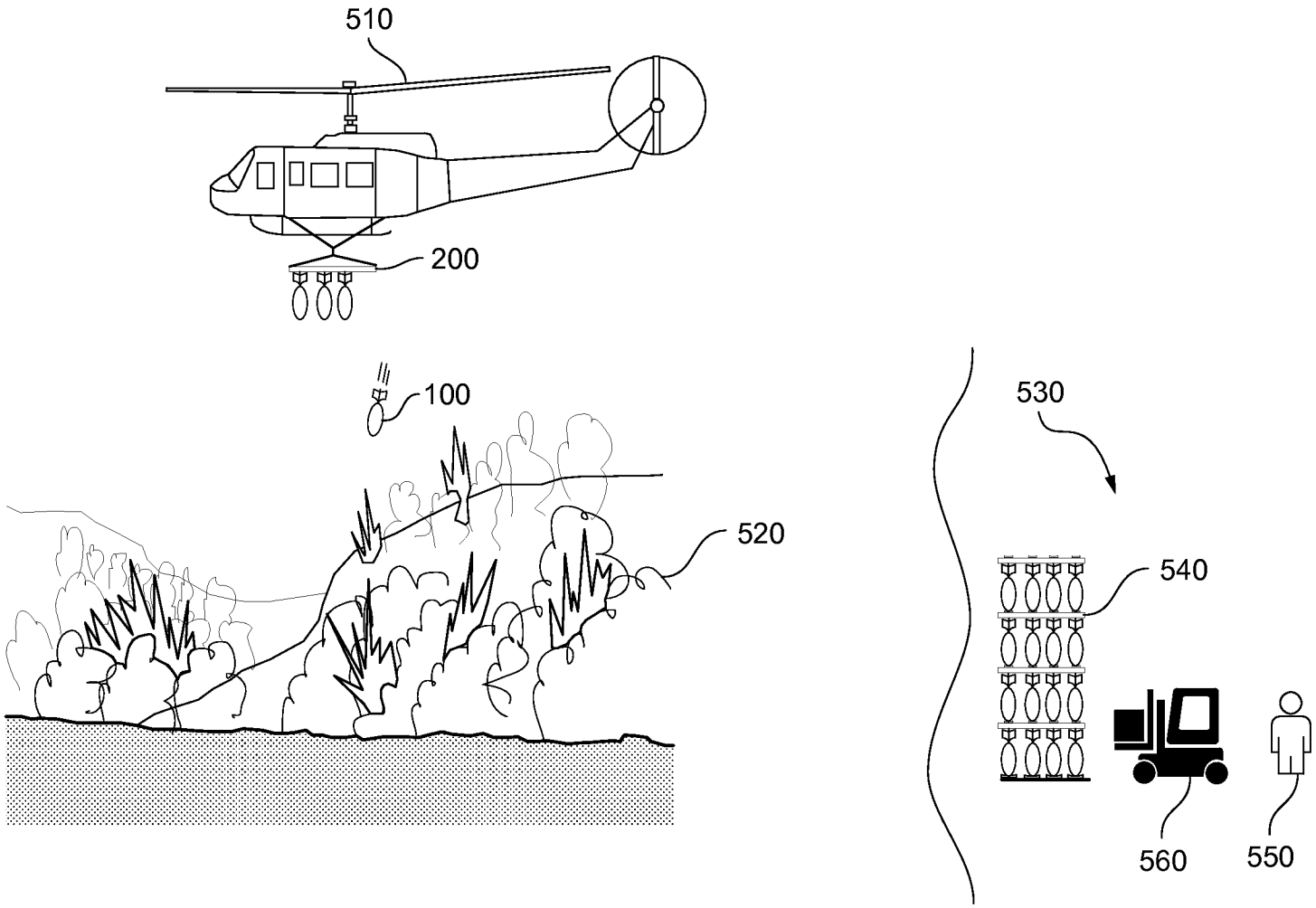
FIG. 5 is an illustration of a delivery apparatus of FIG. 2, delivering firefighting apparatus of FIG. 1 onto a wildfire, according to the teachings of the present invention.

FIG. 5 is an illustration of a rotary-winged aircraft 510 delivering firefighting apparatus 100 to a wildfire site 520, by means of a delivery apparatus, such as delivery apparatus 200. Other delivery apparatus and methods for delivery of firefighting apparatus may be used. A fixed wing aircraft also can be used, with some adjustments for firefighting apparatus trajectory into the fire. Control panel 290 can allow selected apparatus 100 or groups of apparatus 100 to be dropped upon the fire site. In some embodiments, all firefighting apparatus 100 supported within delivery apparatus 200 may be delivered, virtually at once. As previously noted, firefighting apparatus 100 can detonate at the predetermined height, for example, 200 ft. above ground level, bursting a plume of firefighting powder onto the fire site. In some instances, the blast effects of the core charge explosion may extinguish the flame, and the fire retardant can prevent fire reflash. For a large fire, multiple drops may need to be made, with the aircraft returning to a safe location to release depleted delivery apparatus 200 and re-load with a fresh delivery apparatus 200, complete with its complement of firefighting apparatus 100. In some embodiments, delivery apparatus 200 and firefighting apparatus 100 may be brought in as a unit and stacked 540 at a remote site 530, for example by personnel 550 with a forklift 560. In any event, the aircraft can take-off and land from remote make-shift airfields far from water or other firefighting resources, if necessary.

The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings, although not every figure may repeat each and every feature that has been shown in another figure in order to not obscure certain features or overwhelm the figure with repetitive indicia. It is understood that the invention is not limited to the specific methodology, devices, apparatuses, materials, applications, etc., described herein, as these may vary. It is also to be understood that the terminology used herein is used for the purpose of describing particular embodiments only, and is not intended to limit the scope of the invention.

What is claimed is:

1. A firefighting apparatus, comprising:

a containerless core of a preselected fire retardant material, wherein the preselected fire retardant material is compressed to form a prolate spheroid shape, having a core tail, a core nose, and a core channel extending therebetween;

a shaft coupled to and extending from the core tail, the shaft having a proximal end near the core tail and a distal end opposite the proximal end;

a plurality of fins coupled to the distal end of the shaft;

a core charge of a preselected explosive material disposed within the core channel;

an altimeter sensor coupled to the core charge;

a triggering mechanism coupled between the altimeter sensor and the core charge, wherein the altimeter sensor causes the triggering mechanism to detonate the core charge, when the apparatus reaches a predetermined altitude an arming mechanism coupled to the triggering mechanism, the arming mechanism causing the triggering mechanism to arm the core charge for explosion in an armed state and to prevent the core charge from exploding in a stand-down state, the arming mechanism having an arming tab extending from the shaft distal end a nose cone coupled to the core nose, the nose cone having the altimeter sensor and the triggering mechanism disposed therein, the triggering mechanism coupled between the altimeter sensor and the core charge, and a spiked spine traversing the core from the nose cone to the shaft distal end, a plurality spikes extending laterally from the spiked spine into the compressed preselected fire retardant material preventing shifting thereof.

2. The firefighting apparatus of claim 1, further comprising:

a carrying hook coupled to the shaft distal end, the carrying hook disposed to suspend the firefighting apparatus when in transit to a locus of a fire.

3. The firefighting apparatus of claim 2, wherein the preselected fire retardant material comprises:

calcium carbonate powder.

4. The firefighting apparatus of claim 3, further comprising:

an indigenous grass seed.

5. The firefighting apparatus of claim 3, wherein the preselected fire retardant material comprises:

magnesium carbonate powder.

6. The firefighting apparatus of claim 5 further comprising:

an indigenous plant seed.

7. The firefighting apparatus of claim 6, further comprising: at least one of powders of magnesium carbonate, ammonium sulfate, diammonium sulfate, diammonium phosphate, ammonium polyphosphate, or monoammonium phosphate intermixed with the fire retardant material.

8. A firefighting apparatus, comprising:

a containerless core of a preselected fire retardant material, wherein the preselected fire retardant material is compressed to form a prolate spheroid shape, having a core tail, a core nose, and a core channel extending therebetween;

a shaft coupled to and extending from the core tail, the shaft having a proximal end near the core tail and a distal end opposite the proximal end;

a plurality of fins coupled to the distal end of the shaft;

a core charge of a preselected explosive material disposed within the core channel;

an altimeter sensor coupled to the core charge;

a triggering mechanism coupled between the altimeter sensor and the core charge, wherein the altimeter sensor causes the triggering mechanism to detonate the core charge, when the apparatus reaches a predetermined altitude;

a carrying hook extending from the shaft of the firefighting apparatus; and a delivery apparatus including a frame having a frame top and a frame bottom, carry harness, at least one holding hook coupled to the frame bottom, and a nose cup on the frame top, wherein the carrying hook is releasably coupled to the holding hook, wherein the carry harness supports the transport of the delivery apparatus.

* * * * *